US006068145A

United States Patent [19]

Luke

[11] Patent Number: 6,068,145

[45] Date of Patent: May 30, 2000

[54] ANTI-TWO BLOCK SYSTEM

[75] Inventor: Stephen Luke, Broussard, La.

[73] Assignee: MSI Crane & Equipment Co., Katy, Tex.

[21] Appl. No.: 09/127,936

[22] Filed: Aug. 3, 1998

[51] Int. Cl.[7] ..... B66D 1/54

[52] U.S. Cl. ..... 212/281; 254/269

[58] Field of Search ..... 212/281; 254/269

[56] References Cited

U.S. PATENT DOCUMENTS

| | | | |
|---|---|---|---|
| 2,006,869 | 7/1935 | Neuman | 254/269 |
| 3,922,789 | 12/1975 | Sarrell . | |
| 3,924,752 | 12/1975 | Hoofnagle | 212/281 |
| 3,936,622 | 2/1976 | McElroy | 212/281 |
| 4,042,213 | 8/1977 | Schreyer et al. | 212/281 |
| 4,067,447 | 1/1978 | Goss et al. | 212/281 |
| 4,170,308 | 10/1979 | Rogers | 54/269 |
| 4,219,121 | 8/1980 | McPeak | 212/281 |
| 4,280,628 | 7/1981 | Goss et al. . | |
| 4,300,134 | 11/1981 | Paciorek | 212/281 |
| 4,424,909 | 1/1984 | Bergeron | 212/281 |
| 4,523,686 | 6/1985 | Moore et al. . | |
| 5,263,660 | 11/1993 | Brozik . | |

FOREIGN PATENT DOCUMENTS

| | | | |
|---|---|---|---|
| 31035 | 7/1981 | European Pat. Off. | 212/281 |

*Primary Examiner*—Thomas J. Brahan
*Attorney, Agent, or Firm*—Harrison & Egbert

[57] ABSTRACT

An anti-two block system for a crane having a body formed of a first plate and a second plate, a weighted member connected to the second plate of the body so as to contact a travelling member of the crane when the travelling member moves upwardly beyond a desired level, and a valve affixed to the first plate of the body. The valve is movable between a first position closing the valve and a second position opening the valve. The valve serves to pass fluid flow therethrough in response to a contact between the travelling member and the weighted member. The first plate is connected to the second plate. A spring is interactively connected between the plates so as to urge the second plate upwardly along the first plate when the travelling member contacts the weighted member. The weighted member has a weight so as to overcome the resistance of the spring such that the valve resides in the first position in the absence of contact between the weighted member and the travelling member.

18 Claims, 5 Drawing Sheets

ANTI-TWO BLOCK SYSTEM

TECHNICAL FIELD

The present invention relates to safety controls for cranes. More particularly, the present invention relates to anti-two block devices for cranes having booms.

BACKGROUND ART

Cranes are used to raise, shift and lower heavy objects or loads by means or a projecting, swinging arm or boom in conjunction with a hoisting apparatus. The hoisting apparatus can comprise a cable extending adjacent the boom, wound around a sheave situated near the inner end of the boom at one end and having a load block assembly attached at the other end. The load block assembly can consist of an upper load block or boom point sheave assembly attached at the outer end of the boom or boom point and a lower load block or hook assembly, which includes a movable sheave and a load attachment means. The cable extends past the upper load block to support the lower load block. During the normal course of operation of the crane, the lower load block is maintained at a distance below the upper load block.

Such a crane can contain various moving parts which are coordinated to facilitate the attachment and transportation of objects. The boom can have the capacity for being elevated and lowered, as well as having extendable and retractable telescoping boom sections. Additionally, the cable can be reeled in and let out over the inner boom sheave. The retrieval and transportation of a load is achieved through various combinations of reeling in and paying out the cable, raising and lowering the boom, and extending and retracting the telescoping boom sections.

There is a danger, during the operation of the crane, of the lower load block coming in contact with the boom point, upper load block or other components attached thereon. Such contact could result in costly damage to the crane or its load. The cable could break resulting in the load and lower load block falling to the ground. The load could detach from the lower load block and fall. Alternatively, the load block could move over the boom point with the resulting interference damaging the components at their point of contact. Each possibility is clearly undesirable.

"Two-blocking" refers to the condition when the lower load block comes in contact with the upper load block. Extending or lowering the boom without sufficiently unwinding the cable and reeling in the cable too far can cause two blocking. As mentioned previously, it is important that the lower load block be prevented from coming into contact with the upper load block. Therefore, cranes installed with a load block assembly would benefit greatly from an anti-two block device.

There are safety control systems adapted for installation on extension booms that prevent two-blocking. In a typical system a switch is installed near the upper load block. The switch has a lever with a chain and a weight attached thereon. The cable is threaded through the weight. The weight maintains the switch in the working position. As the lower load block comes in contact with the weight, the tension in the chain relaxes, thereby releasing the lever of the switch which stops all activity which could endanger the boom apparatus.

In the past, various patents have issued relating to certain anti-two block systems.

For example, U.S. Pat. No. 3,922,789, issued on Dec. 2, 1975 to I. D. Sarrell, describes a boom length sensing system with a two-block condition sensing. This system includes the use of a single electrically conductive cable mounted on the boom of the crane. The cable is wound on a spring-biased reel mounted for rotation on a non-extending portion of the crane boom with one end of the cable secured to and electrically connected to the uppermost movable section of the crane boom. A constant current is supplied to the cable through an electrical contacter arranged to permit movement of the cable as the boom is varied in length. The constant current is also supplied to a circuit in parallel with the cable and the circuit senses a resistance value for the length of the cable between the contacter and the end secured to the movable section of the boom crane in response to the current flowing through the cable. The circuit in parallel with the cable senses an open condition of the normally closed switch so as to provide a manifestation of an impending two-block condition.

U.S. Pat. No. 4,280,628, issued on Jul. 28, 1981, to Goss et al. describes an anti-two block system which is adapted to be used with a crane for the prevention of damage to the boom tip of the boom of the crane by the travelling member. The anti-two block system includes an engaging mechanism movably mounted with the boom tip for engaging the travelling member when the travelling member moves into close proximity to the boom tip during lifting operations of the travelling member.

U.S. Pat. No. 4,523,686, issued on Jun. 18, 1985, to Moore et al., also describes an anti-two block system. This system includes a boom hoist drum driven by a first hydraulic motor with a first variable displacement motor controlled by a first ram movable in a given direction so as to supply fluid pressure for driving the boom drum to lower a boom and a hook drum driven by a second hydraulic motor with a second variable displacement pump controlled by a second ram movable in a given direction to supply fluid pressure for driving the hook drum to raise a hook block. A differential mechanism sums the movement of the hook block and boom and activates a switch to energize a solenoid valve. When the hook block is a predetermined distance from the boom, the differential mechanism serves to preclude movement of the rams in the given directions.

U.S. Pat. No. 5,263,660, issued on Nov. 23, 1993 to J. Brozik, teaches another anti-two blocking device for preventing a lower load block on a crane from coming into contact with an upper load block. The device includes a cable follower through which the crane's cable is threaded and situated between the upper load block and the lower load block. When the lower load block is within a predetermined distance of the upper load block, the lower load block reaches the cable follower and exerts an upward force which causes the cable follower to activate an actuator for a switch. The switch deactivates all activity on the crane which could cause the lower load block to come into contact with the upper load block.

It is an object of the present invention to provide an anti-two block system which prevents contact between the travelling member and the boom tip of the crane.

It is another object of the present invention to provide an anti-two block system that can be easily installed.

It is another object of the present invention to provide an anti-two block system which avoids contact with the hoist line of the crane.

It is another object of the present invention to provide an anti-two block system in which each of the components can be easily replaced at minimal cost.

It is another object of the present invention to provide an anti-two block system which minimizes electrical and mechanical components while increasing the life of the system.

It is still another object of the present invention to provide an anti-two block system which is relatively inexpensive, easy to manufacture, and easy to use.

These and other objects and advantages of the present invention will become apparent from a reading of the attached specification and appended claims.

SUMMARY OF THE INVENTION

The present invention is an anti-two block system for a crane comprising a body having means for connecting to a boom of the crane, a weight member connected to the body and having means for contacting a travelling member of the crane when the travelling member moves upwardly beyond a desired level, and a valve connected to the body which is movable between a first position closing the valve and a second position opening the valve. The valve serves to pass a fluid flow therethrough in response to a contact between the travelling member and the weighted member.

In the present invention, the body comprises a first plate having the means thereon for connecting to the boom of the crane, and a second plate slidably connected to the first plate. The second plate is connected to the weighted member. A spring is interactively connected to the first and second plates so as to urge the second plate upwardly along the first plate when the travelling member contacts the weighted member. The second plate has a first elongated slot and a second elongated slot formed therein. The first elongated slot receives a bolt affixed to the first plate. The second elongated slot receives another bolt affixed to the first plate. The second plate has an opening formed therein. The valve is affixed to the first plate and positioned within the opening of the second plate. A plunger abuts an edge of the opening of the second plate. The plunger serves to move the valve between the first and second positions relative to the sliding movement between the first and second plates.

The valve is connected to the hydraulic system of the crane. The valve is in the first position when the second plate is in a lower position relative to the first plate. The valve is in the second position when the second plate is in an upper position relative to the first plate.

In the present invention, the weighted member includes a sleeve which extends around the hoist line of the crane. The sleeve has a suitable weight for maintaining the valve in a first position in the absence of contact between the weighted member and the travelling member of the crane. In particular, the sleeve includes a tubular member having an internal diameter greater than a diameter of the hoist line, and an abutment member affixed to a bottom of the tubular member. A connecting line is affixed at one end to the sleeve and affixed at another end to the body. The sleeve has a weight suitable for overcoming a resistance of the spring on the body.

DETAILED DESCRIPTION OF THE INVENTION

Figure 1:
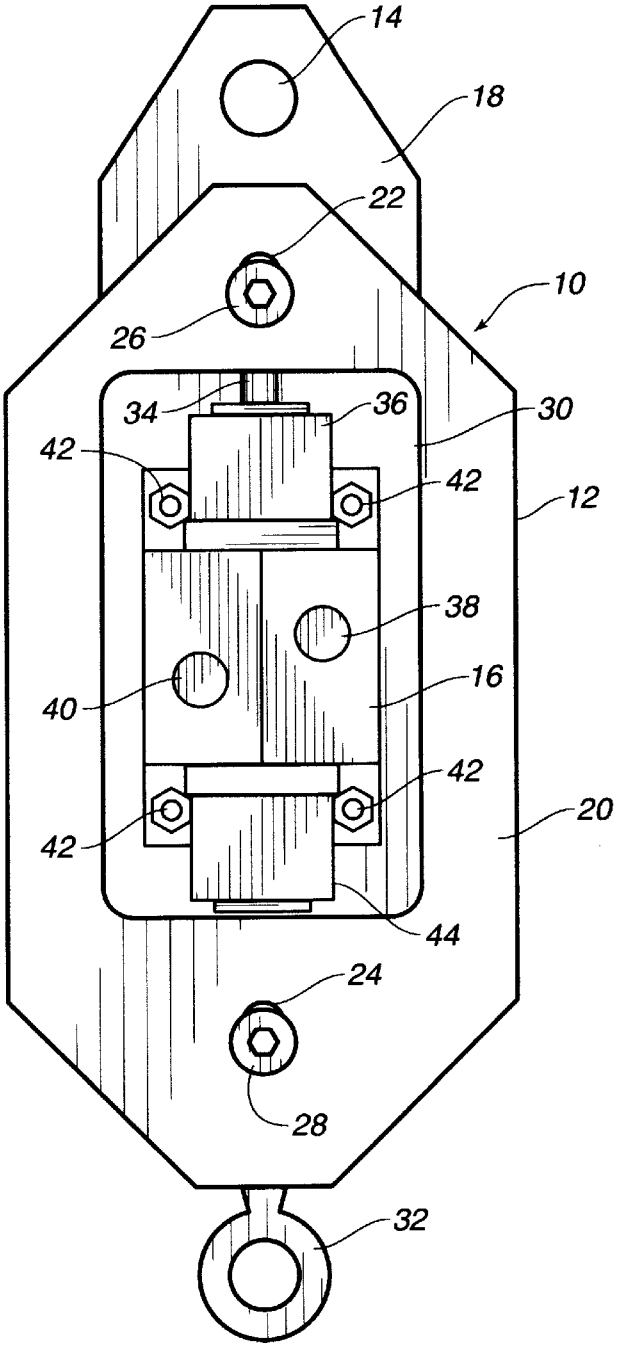
FIG. 1 is a frontal view of the mechanism of the anti-two block system of the present invention.

Referring to FIG. 1, there is shown at 10 the mechanism of the anti-two block system of the present invention. The mechanism 10 includes a body 12 including a means 14 for connection to the boom of a crane. A valve 16 is affixed to the body 12. The valve 16 is movable between first position closing the valve and a second position opening the valve. The valve 16 serves to pass fluid flow therethrough in response to a contact between the travelling member of the crane and a weighted member of the present invention. The illustration of the weighted member of the present invention and the travelling member of the crane are shown, with particularity in FIGS. 6 and 7.

In FIG. 1, it can be seen that the body 12 includes a first plate 18 and a second plate 20 which are affixed in slidable relationship to one another. In particular, the second plate 20 includes a first elongated slot 22 and a second elongated slot 24. A bolt 26 extends through the elongated slot 22 and is secured to the first plate 18. Bolt 28 extends through the second elongated slot 24 and is secured to the first plate 18. In this manner, the second plate 20 is configured so as to be in slidable relationship with the first plate 18.

The first plate 18 extends above the top of the second plate 20 for a small distance. The means 14 for connection to the boom of a crane is a hole formed in the upper end of the first plate 18.

The second plate 20 includes an interior opening 30 which is formed generally centrally through the second plate 20. The valve 16 is positioned within the opening 30. The second plate 20 includes an eyelet 32 at the bottom of the second plate 20. Eyelet 32 serves to connect the bottom of the second plate 20 to a connecting line attached to the weighted member of the present invention.

The valve member 16 includes a plunger 34 which has an end abutting an edge of the opening 30 formed in the second plate 20. The plunger 34 serves to exert compressive contact with the edge of the opening 30 of the second plate 20 so as to urge the second plate 20 upwardly along the first plate 18 in the absence of downward forces applied to the eyelet 32 on the second plate 20. The configuration of the spring mechanism of the plunger 34 is shown, with particularity, in FIG. 5. The plunger 34 is connected to the valve body 36 so as to actuate a valve mechanism contained therein. The valve mechanism 16 is a directional control valve (two positions, four-way). The valve 16 includes an opening 38 for connection to a hydraulic line from the hydraulic system of the crane. Another opening 40 is provided in the valve 16 for connection to the hydraulic system of the crane. When the mechanism 10 is in its lowermost normal position, fluid flow between the openings 38 and 40 is effectively blocked. As such, the hydraulic system of the crane can develop suitable pressure for the actuation of the hoist line of the crane. When the second plate 20 is in its uppermost position relative to the first plate 18 (as illustrated in FIG. 1), fluid flow will effectively pass through the interior of the valve 16 and between the openings 38 and 40. As such, the valve 16 serves to allow the hydraulic fluid of the crane to be effectively "dumped" into a dump reservoir. Any hydraulic action affecting the hoist line of the crane is thereby stopped.

In FIG. 1, it can be seen that the valve 16 is affixed to the surface of the first plate 18. Threaded members 42 serve to properly affix a plate attached to the valve 16 to the surface of the first plate 18. A cap 44 extends from the bottom of the valve 38. The valve 16 is of a conventional configuration in which the actuation of the valve is carried out by a depression of the plunger 34.

Figure 2:
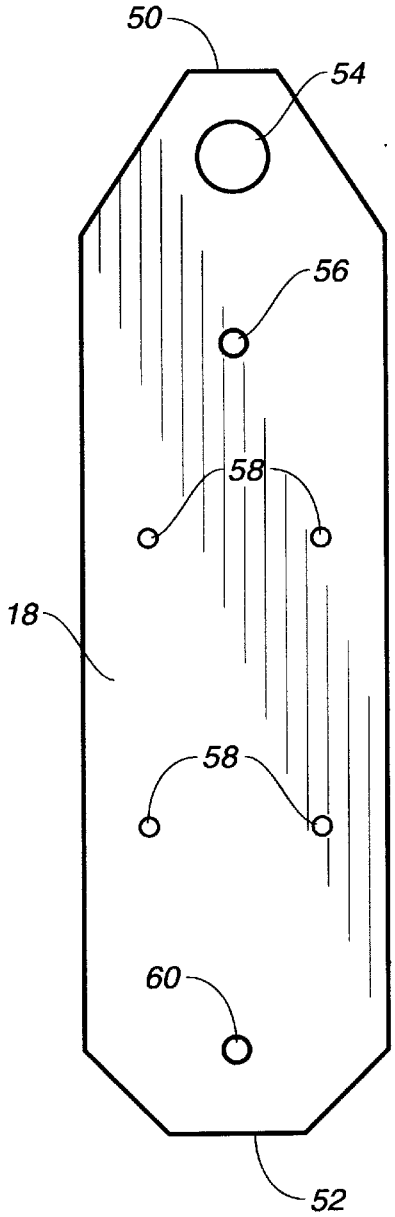
FIG. 2 is an isolated view of the first plate of the anti-two block system of the present invention.

FIG. 2 shows an isolated view of the first plate 18. As can be seen, the first plate 18 includes a top end 50 and a bottom end 52. Opening 54 is provided adjacent to the top end 50 so as to allow the first plate 18 to be pivotally secured to the boom of the crane. Hole 56 is provided on the first plate 18 so as to threadedly receive bolt 26. Holes 58 are also provided on the first plate 18 so as to allow the valve 16 to be threadedly secured in its proper position on the surface of the plate 18. A lower hole 60 is provided so as to receive the bolt 28. The uppermost portion of the plate 18 will extend outwardly beyond the uppermost portion of the second plate 20. The lower end 52 of the first plate 18 will terminate before the bottom of the second plate 20.

Figure 3:
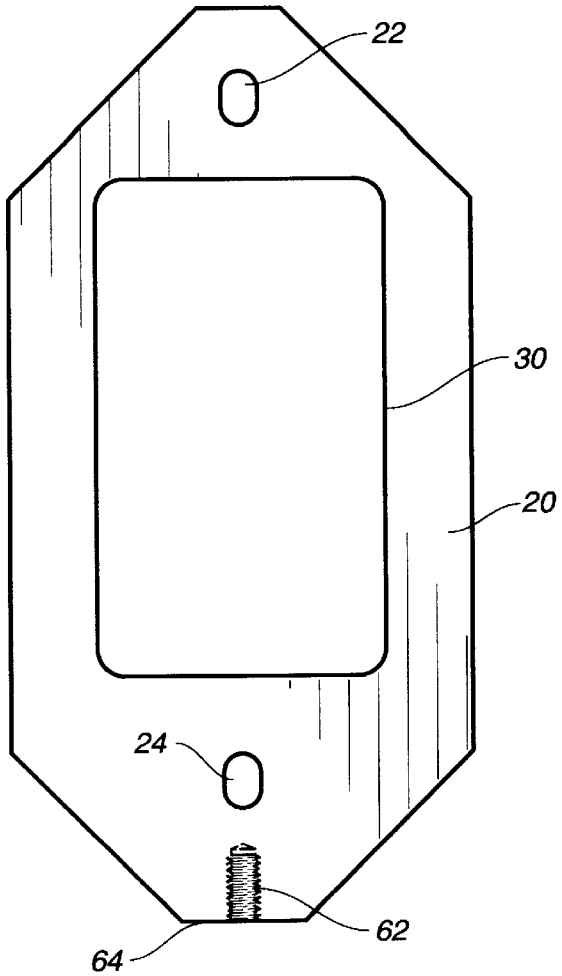
FIG. 3 is an isolated frontal view of the second plate of the anti-two block system of the present invention.

FIG. 3 shows an isolated view of the second plate 20. It can be seen that the second plate 20 includes a first elongated slot 22 and a second elongated slot 24. Elongated slots 22 and 24 serve to define the path of travel of the second plate 20 relative to the first plate 18. Each of the elongated slots 22 and 24 are longitudinally and axially aligned with one another so that a linear travel is achieved between the second plate 20 and the first plate 18. Opening 30 is provided on the interior of the second plate 20 so as to accommodate the valve 16 therein. A connector orifice 62 is provided at the bottom 64 of the second plate 20 so as to receive the eyelet 32 therein.

Figure 4:
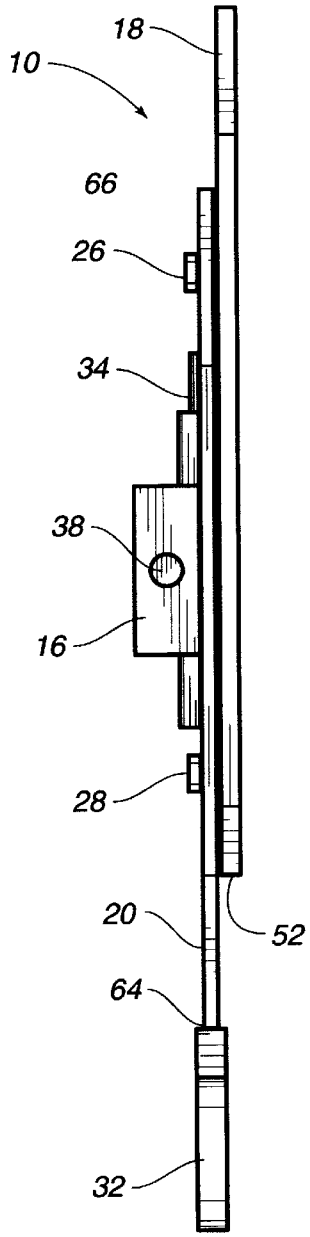
FIG. 4 is a side view of the mechanism of the anti-two block system of the present invention.

FIG. 4 shows a side view of the mechanism 10 of the present invention. As can be seen, the mechanism 10 has a generally flat profile. It can be seen that the first plate 18 extends upwardly above the top 66 of the second plate 20. The second plate 20 resides in generally surface-to-surface contact with the first plate 18. The bottom 52 of the first plate 18 terminates before the bottom 64 of the second plate 20. The eyelet 32 extends downwardly below the bottom 64 of the second plate 20. Bolts 26 and 28 serve to secure the first plate 18 to the second plate 20 and to allow for the slidable movement therebetween. The plunger 34 of the valve 16 abuts an edge of the opening 30 of the second plate 20. As can be seen, the valve body 16 includes opening 38 so as to allow hydraulic fluid to enter the valve body 16.

Figure 5:
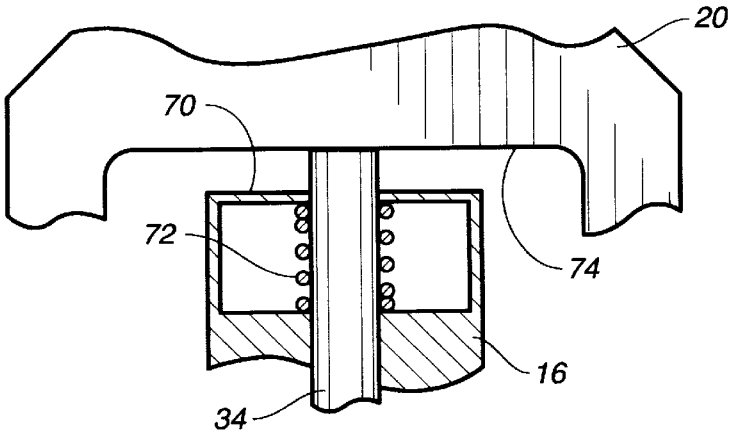
FIG. 5 is a diagrammatic illustration of the arrangement of the plunger and spring as used within the mechanism of the present invention.

In FIG. 5, a close view of the plunger 34 is illustrated. In particular, it can be seen that the plunger 34 extends outwardly from the top 70 of the valve body 16. A spring 72 is formed on the interior of the valve body 16 so as to urge the plunger 34 upwardly. The spring 72 is a compression spring that exerts an upward force on the plunger 34. As such, the plunger 34 will act as a spring so as to resist the downward movement of the second plate 20 with respect to the first plate 18. So as to overcome this resistive force of the spring 72, a weight is applied to the second plate 20 which serves to push the plunger 34 downwardly such that the second plate 20 will reside in its lowermost position relative to the first plate 18. It can be seen that the top of plunger 34 engages the top edge 74 of the opening 30 of the second plate 20.

Figure 6:
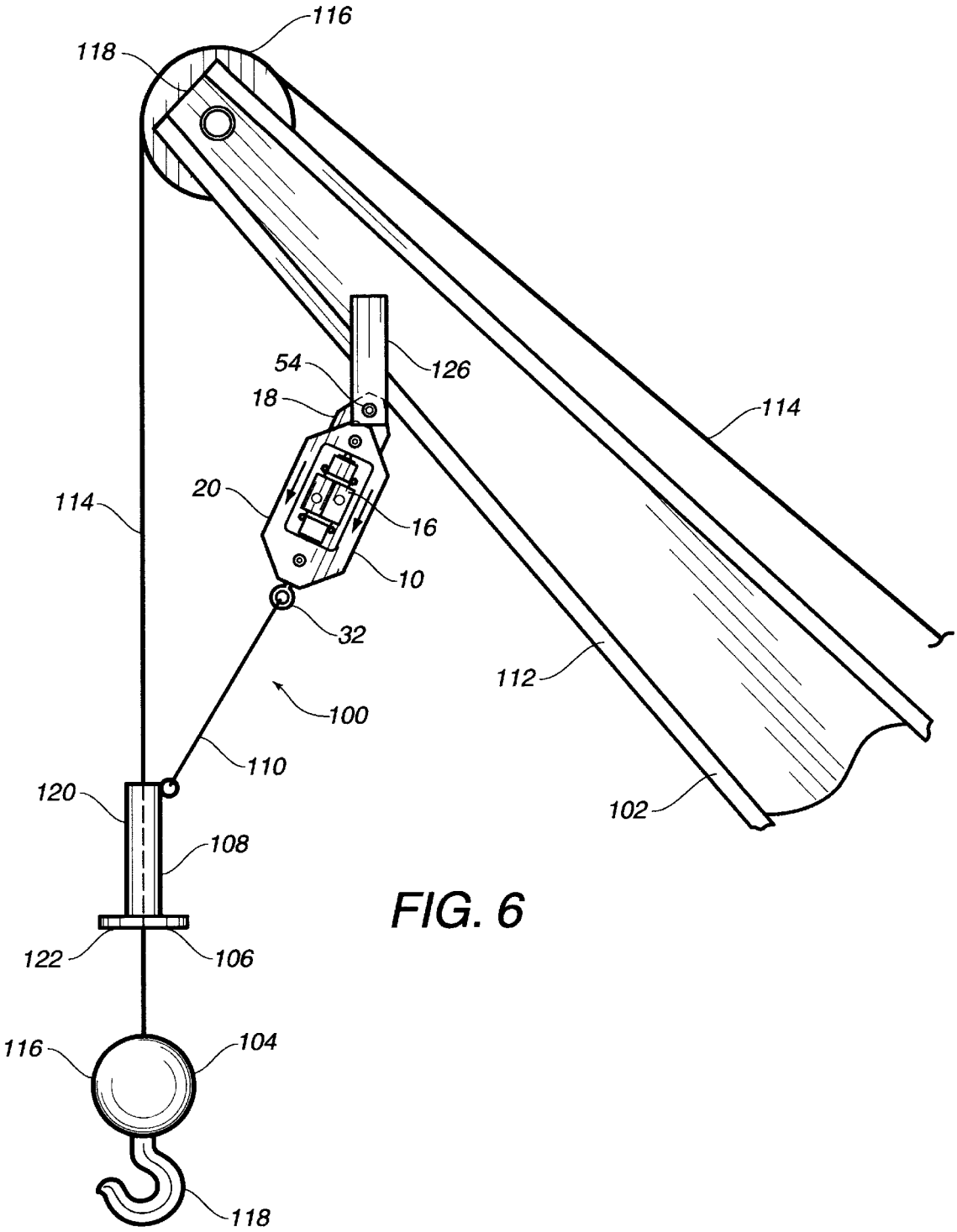
FIG. 6 is an illustration showing the operation of the anti-two block system of the present invention in its normal non-contact position.

FIG. 6 shows an isolated view of the operation of the anti-two block system 100 of the present invention. It can be seen that the anti-two block system 100 of the present invention includes the anti-two block mechanism 10. The illustration of FIG. 6 shows the operation of the anti-two block system 100 in the normal operation of the crane 102. In the normal operation of the crane 102, there will be no contact between the travelling member 104 and the bottom surface 106 of the sleeve 108. As such, the sleeve 108 serves as the "weighted member" for exerting a downward pulling force on a connecting line 110 connected to the eyelet 32 of the anti-two block mechanism 10.

With reference to FIG. 6, it can be seen that a boom 112 extends from the crane. A hoist line 114 extends upwardly along the boom 112 and extends over a sheave 116 at the tip 118 of the crane 102. The hoist line 114 then extends downwardly to the travelling member 104. The travelling member 104 includes a ball 116 and a hook 118. The travelling member 104 can be various other types of apparatus and devices that are connected to the end of the hoist line 114. The intended purpose of the present invention serves to prevent contact between the travelling member 104 and the sheave 116 or the tip 118 of the boom 102.

In FIG. 6, it can be seen that the sleeve 108 includes a tubular portion 120 which extends around the exterior of the hoist line 114. As such, the tubular member 120 should have an interior diameter which is greater than the exterior diameter of the hoist line 114. An abutment surface 122 is attached to the end of the tubular member 120 so as to be the contact surface with the travelling member 104. The abutment member 122 can be an annular member that is affixed to the bottom of the sheave 108. Alternatively, within the concept of the present invention, various other configurations of weighted members 108 can be incorporated into the present invention. The important feature of the present invention is simply that the weighted member 108 extend relative to the hoist line 114 so as to provide a limit on the upward travel of the travelling member 104 with respect to the boom 112. Ultimately, the weighted member 108 should have a suitable weight such that the connecting line 110 remains taut and has suitable weight so as to overcome the resistance of the spring 72.

In FIG. 6, it can be seen that a bracket 126 is affixed to the boom 112 just below the tip 118 of the boom 112. The first plate 18 has its hole 54 pivotally secured to the bracket 126. As such, the mechanism 10 is free to pivot on the boom and remain in a linear position with the weighted member 108 at any angle of the boom 112. This serves to eliminate pulleys and additional brackets that could restrict the valve actuation and spool movement. The direct linear pull on the valve decreases the side load so as to increase the life of the valve and ultimately extend the life of the system.

It can be seen in FIG. 6 that the weighted member 108 causes the second plate 20 to be pulled downwardly relative to the first plate 18. In this lowermost position, the flow of hydraulic fluid through the valve 16 is effectively blocked. As such, the pressure of the system hydraulics remains high for the purposes of allowing the hoist line 114 to be suitably lifted.

Figure 7:
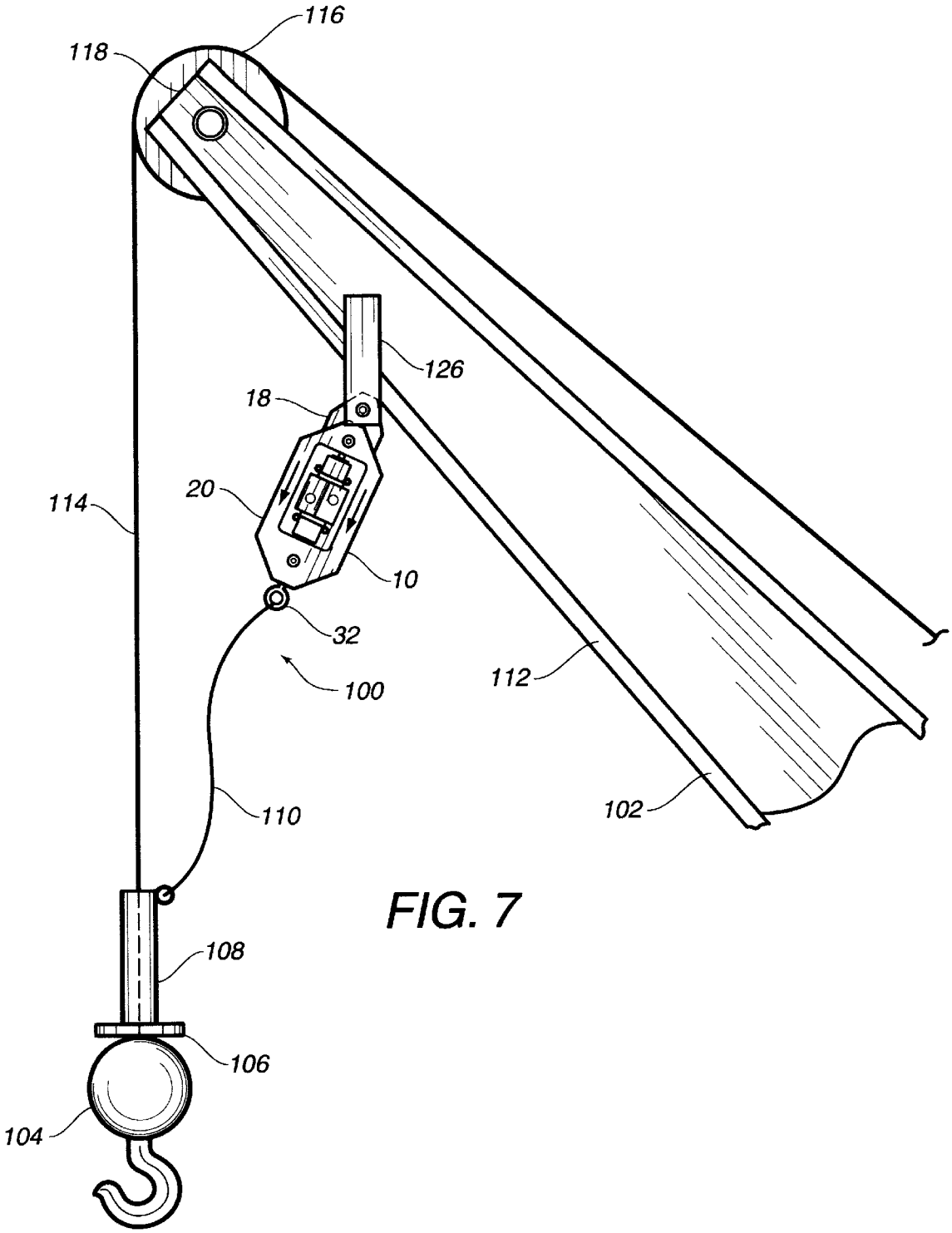
FIG. 7 is an illustration of the anti-two block system of the present invention as shown in its position in which the travelling member contacts the weighted member.

FIG. 7 shows the situation in which a contact occurs between the travelling member 104 and the bottom surface 106 of the weighted member 108. In this circumstance, the hoist line 114 has been raised to the point that the travelling member 104 is above a desired level. When contact occurs between the travelling member 104 and the weighted member 108, the connecting line 110 becomes loose. As such, the action of the spring 72 will cause the second plate 20 to move upwardly relative to the first plate 18 on the anti-two block mechanism 10. When this action occurs, the valve is opened so that fluid flow will occur between the opening 38 and the opening 40. The hydraulic fluid is effectively "dumped" from the system so as to prevent any further upward movement of the hoist line 114. In this situation, the travelling member 104 is prevented from encountering damaging contact with the sheave 116 or the tip 118 of the boom 112. When the hydraulic fluid of the crane system is "dumped", lifting of the hoist line 114 is prevented and the travelling member 104 may lower gradually. Once the travelling member 104 lowers to the point that the weighted member 108 returns to the position shown in FIG. 6, then the system is automatically activated again for the purposes of hoisting loads.

Figure 8:
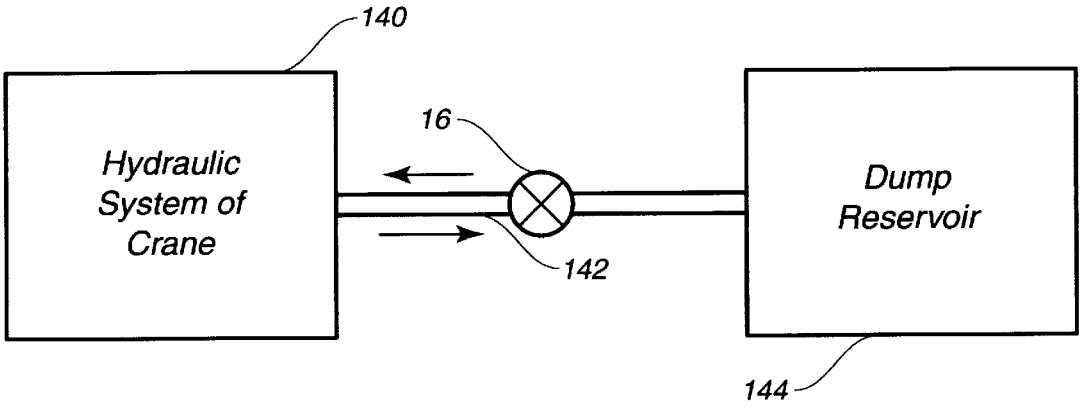
FIG. 8 is a diagrammatic representation of the hydraulic connection of the hydraulic system of the crane to the anti-two block system of the present invention during normal operation.

FIG. 8 is a diagrammatic illustration of the operation of the valve member 16 relative to the hydraulic system of the crane. As can be seen, the hydraulic system of the crane 140 is connected by a conduit 142 to the opening 38 in the valve 16. FIG. 8 illustrates the position in which the crane operates normally in the manner of FIG. 6. Fluid flow through the valve 16 is effectively blocked so that the pressure of the hydraulic system 140 is maintained. Fluid flow does not pass through the valve to the dump reservoir 144.

Figure 9:
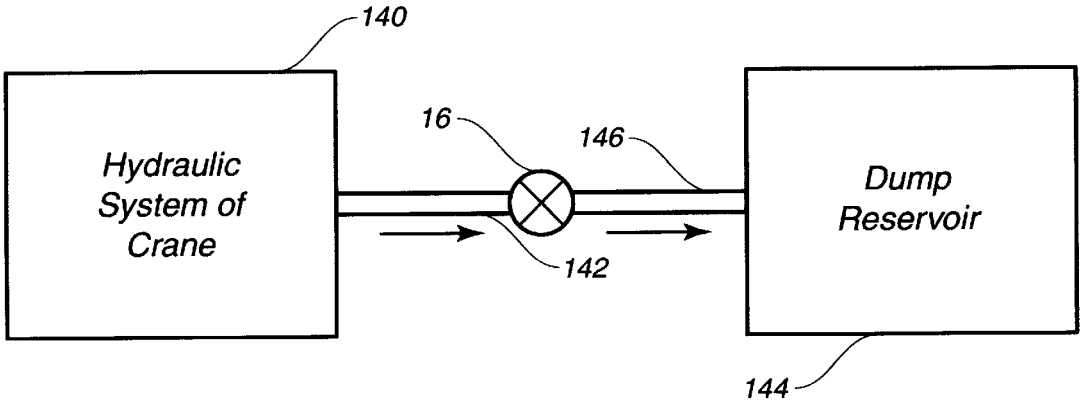
FIG. 9 shows an illustration of the connection between the hydraulic system of the crane under the circumstances in which the travelling member contacts the weighted member.

FIG. 9 illustrates the circumstance in which contact is made between the travelling member 104 and the weighted member 108. In this circumstance, the valve 16 is opened so that fluid flow will pass through the conduit 142 through the valve 16 and through conduit 146 to the dump reservoir 144.

The present invention achieves many advantages over prior art anti-two block systems. Within the concept of the present invention, the spool is of stainless steel material and the valve is of bronze material so as to provide extra protection for marine use. It can be seen that the system 100 of the present invention can be easily installed onto the crane 102. The mechanical portion 10 of the system does not make contact with the hoist line 114. As such, the system 100 eliminates the possibility of wire rope lube build-up which would prevent actuation of the valve 16. The valve 16 can be used as a boom kickout and override valve. This makes for easy replacement and availability. The fasteners used in the present invention are made of 316 stainless steel (in the preferred embodiment) which is corrosion-resistant. Such material will withstand many industrial chemicals and solvents and will also resist pitting.

The anti-two block system 100 of the present invention can be mounted on the right or left side of the boom without any additional accessories or modifications. The individual components can be easily replaced, if needed, at a fraction of the cost of the complete system.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An anti-two block system for a crane comprising:

a body having means for connecting to a boom of the crane;

a weighted member connected to said body, said weighted member having means for contacting a travelling member of the crane when the travelling member moves upwardly beyond a desired level, said body comprising:

a first plate having means thereon for connecting to the boom of the crane; and a second plate slidably connected to said first plate, said second plate being connected to said weighted member; and a valve means affixed to said body, said valve means movable between a first position closing said valve means and a second position opening said valve means, said valve means for controlling fluid flow therethrough in response to a contact between the travelling member and said weighted member, said second plate having an opening formed therein, said valve means affixed to said first plate, said valve means positioned within said opening of said opening of said second plate.

2. The system of claim 1, said body further comprising:

a spring means interactively connected to said first and second plates, said spring means for urging said second plate upwardly along said first plate when the travelling member contacts said weighted member.

3. The system of claim 2, said weighted member comprising:

a sleeve means for extending around a hoist line of the crane, said sleeve means having a weight suitable for overcoming a resistance of said spring means; and a connecting line affixed at one end to said sleeve means and at another end to said second plate.

4. The system of claim 1, said second plate having a first elongated slot and a second elongated slot formed therein, said first elongated slot receiving a bolt affixed to said first plate, said second elongated slot receiving another bolt affixed to said first plate.

5. The system of claim 1, said valve means comprising:

a plunger means abutting an edge of said slot of said second plate, said plunger means for moving said valve means between said first and second positions relative to sliding movement between said first and second plates.

6. The system of claim 1, said valve means being connected to a hydraulic system of the crane, said valve means being in said first position when said second plate is in a lower position relative to said first plate, said valve means being in second position when said second plate is in an upper position relative to said first plate.

7. The system of claim 1, said weighted member comprising:

a sleeve means for extending around a hoist line of the crane, said sleeve means having a weight suitable for maintaining said valve means in said first position in an absence of the contact.

8. The system of claim 7, said sleeve means comprising a tubular member having an internal diameter greater than a diameter of the hoist line, said means for contacting comprising an abutment member affixed to a bottom of said tubular member.

9. The system of claim 7, further comprising:

a connecting line affixed at one end to said sleeve means and affixed at another end to said body.

10. An apparatus comprising:

a crane having a boom extending outwardly therefrom, said crane having a hoist line extending from said boom, said hoist line having a travelling member at one end, said crane having hydraulic means for moving said travelling member upwardly;

a body having means for connecting to said boom of said crane;

a weighted member connected to said body, said weighted member having means for contacting said travelling member when said travelling member moves upwardly beyond a desired level, said body comprising:

a first plate connected to said boom of said crane; and a second plate slidably connected to said first plate, said second plate being connected to said weighted member; and a valve means affixed to said body and hydraulically connected to said hydraulic means of said crane, said valve means for controlling fluid flow therethrough in response to a contract between said travelling member and said weighted member, said second plate having an opening formed therein, said valve means affixed to said first plate, said valve means positioned within said opening of said second plate.

11. The apparatus of claim 10, said body comprising:

a spring means interactively connected to said first and second plates, said spring means for urging said second plate upwardly along said first plate when said travelling member contacts said weighted member.

12. The apparatus of claim 11, said weighted member comprising:

a sleeve extending around said hoist line of said crane, said sleeve having a weight suitable for overcoming a resistance of said spring means; and a connecting line affixed at one end to said sleeve and at another end to said second plate.

13. The apparatus of claim 10, said valve means comprising:

a valve movable between a first position blocking fluid flow therethrough and a second position allowing fluid flow therethrough, said valve being connected to said hydraulic means of said crane, said valve being in said first position in an absence of contact between said weighted member and said travelling member, said valve moving to said second position upon contact between said weighted member and said travelling member.

14. The apparatus of claim 13, said valve means comprising:

a plunger means abutting a surface of said second plate, said plunger means for moving said valve means between said first and second positions relative to a sliding movement between said first and second plates.

15. The apparatus of claim 10, said body being connected to said boom below a tip of said boom, said weighted member being positioned over said hoist line below said tip of said boom.

16. The apparatus of claim 15, said weighted member comprising:

a sleeve means extending around a hoist line of said crane, said sleeve means having a weight suitable for maintaining said valve means in said first position in an absence of contact between said weighted member and said travelling member.

17. The apparatus of claim 16, said sleeve means comprising a tubular member having an internal diameter greater than a diameter of said hoist line, said means for contracting comprising an abutment member affixed to a bottom of said tubular member so as to face said travelling member.

18. The apparatus of claim 16, further comprising:

a connecting line affixed at one end to said sleeve means and affixed at another end to said body.

* * * * *